United States Patent [19]

Suga

[11] 4,184,096

[45] Jan. 15, 1980

[54] WEATHER RESISTANCE AND LIGHT FASTNESS TESTER WITH COOLED XENON LAMP

[76] Inventor: Shigeru Suga, Yoyogi 5-20-2, Shibuya-ku, Tokyo, Japan

[21] Appl. No.: 914,140

[22] Filed: Jun. 9, 1978

[51] Int. Cl.[2] ..... H01J 61/52

[52] U.S. Cl. ..... 313/17

[58] Field of Search ..... 313/17, 22, 24, 36

[56] References Cited

U.S. PATENT DOCUMENTS

| | | | |
|---|---|---|---|
| 2,477,396 | 7/1949 | Weiskopf | 313/36 UX |
| 3,958,142 | 5/1976 | Seitz | 313/22 |

*Primary Examiner*—Rudolph V. Rolinec
*Assistant Examiner*—Darwin R. Hostetter
*Attorney, Agent, or Firm*—Wenderoth, Lind & Ponack

[57] ABSTRACT

A light fastness and weather resistance testing apparatus which has a testing tank, a hollow shaft rotatably mounted in the center of the testing tank, a sample frame mounted on the hollow shaft and extending beyond one end of said hollow shaft, a motor connected to the shaft for rotating the shaft, a tube of electrically conductive metal extending through the hollow shaft and having one end at the space within the sample frame and a supply of cooling liquid connected to the other end of the tube for supplying a cooling liquid to the tube. A xenon lamp is in the space within the sample frame and has a cooling device mounted thereon constituted by a single wall cylindrical tube of an ultraviolet transmissive glass around the lamp and spaced therefrom, the low voltage end of the lamp being mounted on the one end of the metal tube and having the low voltage terminal thereof electrically connected to the metal tube, the other end of the glass tube having a drainage tube connected thereto. A high voltage power terminal is connected to the high voltage terminal of the lamp, and a voltage supply is connected between said other end of the metal tube and the high voltage lamp terminal and includes a connecting wire extending outside the sample frame.

4 Claims, 7 Drawing Figures

WEATHER RESISTANCE AND LIGHT FASTNESS TESTER WITH COOLED XENON LAMP

DETAILED DESCRIPTION OF THE INVENTION

This invention relates to an improvement in means for cooling a xenon lamp used as a light source in a weather resistance or light fastness tester (hereinafter referred to as a "light fastness tester").

BACKGROUND OF THE INVENTION AND PRIOR ART

Since a xenon lamp has spectroscopic properties approximately the same as those of solar rays, it is especially suitable as a light source for a light fastness tester and has come into wide use in recent years.

An example of such a tester is illustrated in FIG. 1. The xenon lamp 2 is vertically disposed at the center of a testing tank 1, and a sample frame 4 having a sample or samples 3 aligned and supported circumferentially around and spaced from the xenon lamp 2 at the center thereof. The sample frame is rotatable on a rotary shaft 5 mounted in bearing 6, and is driven through a bevel gear 7 by a motor 8. While being thus rotated, the sample 3 is irradiated by the rays of light emitted by the xenon lamp whereby the aging, discoloring and fading of the samples are produced. The air temperature inside the tank 1 is elevated due to the heat generated by the lamp 2 during light emission. However, a blower 10 controlled by a temperature controller draws in air from outside the tester and opens an exhaust valve 11 that is opened and closed in accordance with the air pressure produced by the blower 10, thereby replacing the air in the tester with external air and thus automatically maintaining the air temperature inside the tank 1 at a constant level.

In this apparatus, the xenon lamp 2 acting as the light source, which plays the most important role in the light fastness tester, is operated to produce a stable emission of light by means of a lighting device 12. In order to prevent breakage of the lamp 2 due to the high exothermy during light emission, the circumference of the lamp is cooled with water.

The construction of the conventional means for water-cooling the xenon lamp will now be explained with reference to FIG. 2. The xenon lamp 2 is surrounded by a cylindrical inner tube 13 made of an ultraviolet-transmissive glass and the outer circumference of the inner tube 13 is further surrounded by an outer tube 14 made of a similar material. The cooling water enters from an inlet tube 15, flows downward between the xenon lamp 2 and the inner tube 13 while cooling the surface of the lamp, and next flows upward between the inner tube 13 and the outer tube 14 and is finally discharged from an outlet tube 16.

The xenon lamp 2 has a high voltage terminal 17 at the lower end and a low voltage terminal 18 at its upper end, a high voltage lead wire 19 and a low voltage lead wire 20 being connected to the high and low voltage terminals respectively. The other ends of these wires 19 and 20 are connected to the aforementioned lighting device 12. Due to the structural arrangement of the light fastness tester 1 and the means for cooling the xenon lamp, however, the high voltage lead wire 19 extends through the testing tank between the xenon lamp 2 and the sample and, hence, is exposed to the emitted rays of light. In addition, during the time the lamp is lighted, the lead wire 19 is carrying a voltage of several kilovolts or more.

Xenon lamps themselves have conventionally been used in great quantities for advertising and general illumination purposes but only in an extremely limited quantity for the light fastness testing purposes. When a xenon lamp is used for ordinary illumination, the energy in the visible range becomes important in determining the quality of the lamp, whereas the quantity of energy in the ultraviolet range and the drastic attenuation of the energy in the ultraviolet range, which is inherent in discharge lamps of this kind, does not pose a problem. On the contrary, in practice the lamp is used in combination with a filter to cut off the rays in the ultraviolet range.

For light fastness testing purposes, however, research and development have thus far been directed to solving the problems and improving the properties of xenon lamps such as reduction of transmissivity of ultraviolet rays, which is an essential property of the lamp if it is to be used for such testing, due to the structure of the water-cooling means for the lamp, attentuation of the ultraviolet rays during long-running tests (500–2,000 hours) and damage of the xenon lamp. As a result, a xenon lamp having water-cooling means as described above with reference to FIGS. 1 and 2 (hereinafter referred to as a "xenon lamp device") has been developed and is now in practical use.

However, the xenon lamp device shown in FIG. 2 does not provide sufficient stability of the test conditions for the purpose of the light fastness tests. Namely, the conventional xenon lamp water-cooling means shown in FIG. 2 has the following drawbacks:

(1) Heat exchange efficiency is poor during cooling of the lamp.

The cooling water flows from the top to the bottom between the lamp 2 and the inner tube 13 while cooling the surface of the xenon lamp 2, that is, while the temperature of the cooling water is rising, and the thus heated water then flows from the bottom to the top between the inner tube 13 and the outer tube 14. In this arrangement, transfer of heat occurs from the upwardly flowing cooling water, which is at a higher temperature, outside the inner tube to the downwardly flowing cooling water, which is at a lower temperature, inside the inner tube, thereby reducing the cooling efficiency.

(2) Pressure loss is great during the flow of the cooling water.

Since the cooling means has the double tube construction wherein both the inlet and outlet for the cooling water are at the upper portion of the means and the tubes are constructed so that the flow passage is bent double at the lower end to direct the downwardly flowing cooling liquid into the return passage, the frictional resistance at the surface of the tubes is greater by about three times than for a straight through flow cooling water tube. Since the temperature of the cooling water in the layer contacting the surface of the high temperature xenon lamp is raised, the specific gravity of the water in said layer becomes less and the water tends to rise upwardly against the downward flow of the main stream of the fluid. The same reverse flow phenomenon takes place, although to a slightly less degree, in the water layer at the outer surface of the inner tube 13 due to the aforementioned transfer of heat. Furthermore, air bubbles tend to form in said layer against the high temperature surface of the lamp and the air bubbles thus formed rise upward against the flow. These phenomena together result in a great pressure loss. Therefore, if the water main pressure of the cooling water being fed is low, the quantity required for cooling will not flow through the means and a separate pump becomes necessary for raising the pressure, thus resulting in the need for additional equipment.

(3) Loss of irraiation energy (especially attenuation of the ultraviolet rays) directed toward the sample 3 is great.

Contamination of both surfaces of the inner tube 13 and the inner surface of the outer tube 14 (three surfaces all together) resulting from the quality of the water is great and is three times as great as on the single surface of a single tube. The water layer through which the light is transmitted is thick, being double that of a single tube. For these reasons, the transmissivity of the light is low, and attenuation, over the course of time, of the energy of the ultraviolet rays having an especially short wavelength becomes a critical problem in a long-running light fastness test such as a continuous test for 50–2,000 hours.

(4) Degradation of the high voltage lead wire occurs.

As initially explained with reference to FIG. 1, the high voltage lead wire 13 (and the low voltage wire in certain cases) must pass through the gap between the sample 3 and the xenon lamp 2 because of the arrangement of the xenon lamp device secured to the upper portion of the tester and suspended therefrom, and the sample frame 4 rotatably supported below the lamp device. Consequently, the coating material of the lead wire is degraded in the same way as the sample 3 and its service life is shortened.

(5) The lead wire shades the sample being tested. It is not desirable that the lead wire constantly shade the sample 3, even slightly. This shading particularly disturbs the control of the light by an automatic irradiation energy controller incorporating a sensor sensitive to the light and disposed at the position of the sample.

OBJECT AND BRIEF SUMMARY OF THE INVENTION

It is an object of the present invention to provide means for cooling the xenon lamp which eliminates these various drawbacks to as great an extent as possible.

This object is achieved in accordance with the present invention by the provision of means for cooling the xenon lamp comprising a high voltage electrode disposed at the upper rather than the lower portion and a low voltage electrode at the lower rather than the upper portion of the xenon lamp, contrary to the conventional arrangement; a water cooling tube in the form of a single wall cylindrical tube made of an ultraviolet-transmissive glass and surrounding the lamp; throats of a reduced diameter formed at the upper and lower electrode positons of the lamp so as to allow one-way passage of the cooling water from the bottom to the top of the lamp; an electrically conductive copper cooling water feed tube having an electrically insulating coating and functioning also as a low voltage lead wire; and a hollow cylindrical rotary shaft disposed perpendicularly at the center of the testing tank, said copper cooling water feed tube extending through the hollow rotary shaft from the lower portion of the testing tank and coupled to a fixed water tube at the lower end of the cooling tube and being electrically conductive with respect to the low voltage electrode of the xenon lamp.

In the present invention, the low voltage or grounded electrode is moved to the lower portion of the lamp as noted above in order to prevent power loss that would occur if it is situated at the upper portion because the voltage is extremely high at the high voltage electrode and causes discharge to members adjacent thereto such as to the inside of the hollow rotary shaft.

BRIEF DESCRIPTION OF THE FIGURES

One embodiment of the means for cooling the xenon lamp in accordance with the present invention will be explained with reference to the accompanying drawings in which.

DETAILED DESCRIPTION OF THE INVENTION

Figure 3:
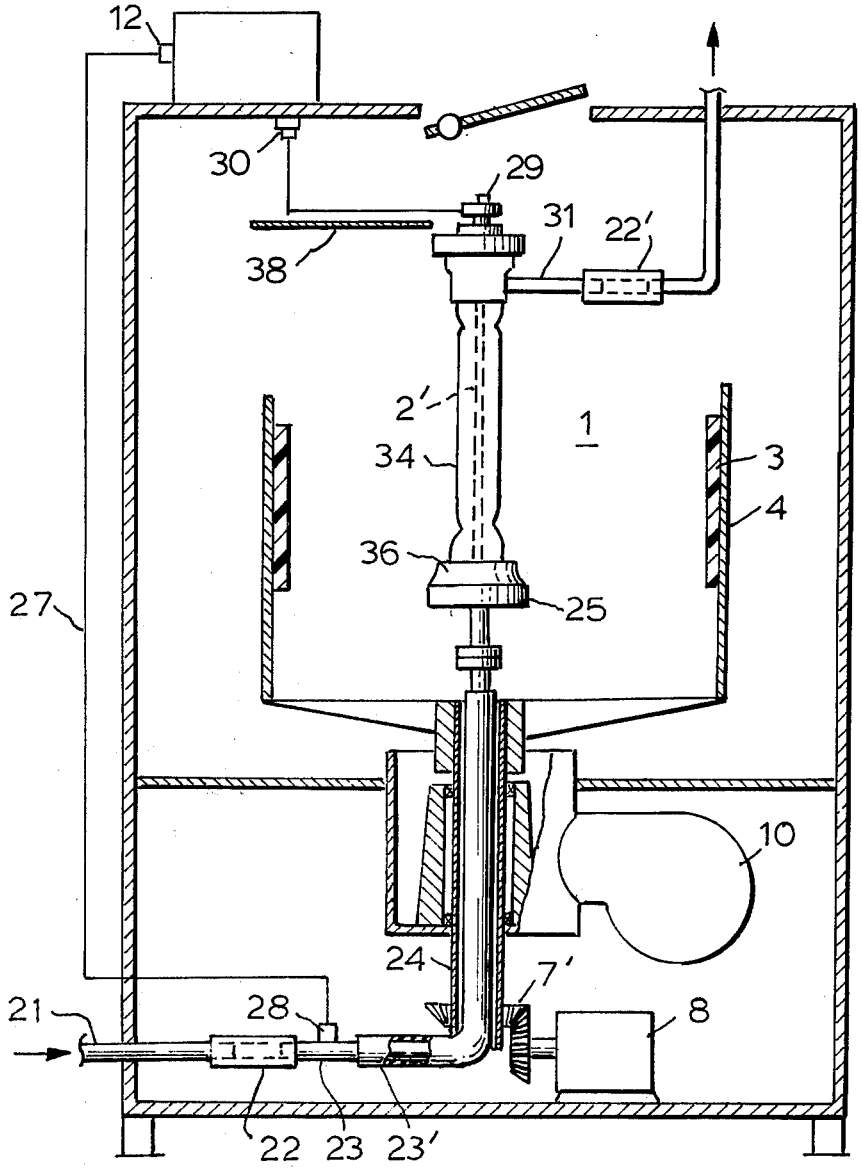
FIG. 3 is a schematic view of the inside of a light fastness tester having a lamp cooling means in accordance with the present invention.

Referring to FIG. 3, there is shown a xenon lamp type testing apparatus having means for cooling the xenon lamp according to the present invention and disposed in a light resistance tester.

As seen in the drawing, a cooling water inlet tube 21 enters the testing tank 1 horizontally at the lower portion of the tester and is connected via an elastic connecting tube 22 to an electrically conductive copper tube 23 having an insulating coating 23' around its outer circumference except at the two end portions. This copper tube 23 extends horizontally to the center of the testing tank 1 and then extends vertically upwardly through a hollow rotary shaft 24 for rotating a sample frame 4, the upper end of the shaft 24 being secured to the center of the bottom of the sample frame 4, and the lower end being coupled to a motor 8 for driving the shaft through a bevel gear 7'. The intermediate portion of the hollow shaft is supported by upper and lower bearings. The copper tube is further inter-connected to a socket joint 25 mounted on the lower end of a xenon lamp 2'. Accordingly, the copper tube 23 does not hinder the rotation of the rotary shaft 24. A low voltage lead wire 27 extends from a lighting device 12 down through the space around the sample frame 4 so that it is not exposed to the emitted light rays and is connected to a lead wire terminal 28 on an exposed portion of the copper tube 23 adjacent to the elastic connecting tube 22.

By arranging the piping and wiring in this manner, it is possible to eliminate the aforementioned (4) and (5), i.e. degradation of the lead wires and shading of the sample by the lead wire.

A high voltage lead wire 30 extends from the lighting device 12 to a high voltage terminal 29 at the upper end of the xenon lamp 2'.

The construction of the xenon lamp cooling means in accordance with the present invention will be described further with reference to FIGS. 4 through 7.

Figure 7:
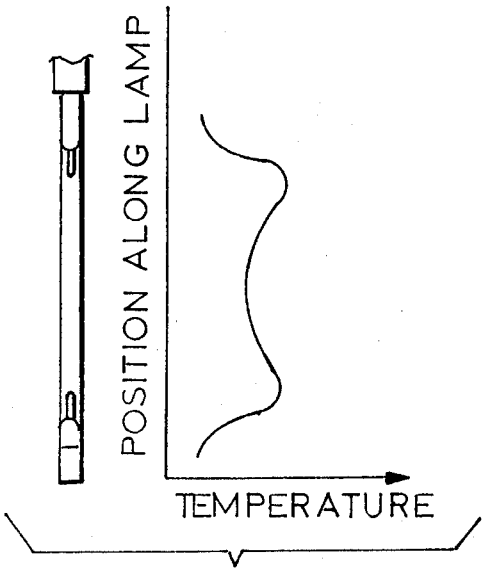
FIG. 7 is a light emission temperature distribution diagram for the xenon lamp device of the present invention.

As can be seen initially from FIG. 7, the exothermic temperature distribution in the longitudinal direction of the lamp due to the light emitted from the xenon lamp is drastically higher at the electrode portions 33 and 33' at the two ends of the lamp.

In heat exchange in general, the velocity of flow of a cooling medium greatly affects the ability of the cooling medium to absorb heat from the surface of a source of heat. The greater the flow velocity, the better the cooling effect. For example, heat exchange using water is as follows:

Heat transfer coefficient due to natural convection:

$$400\text{–}2{,}000\ \text{Kcal/m}^2.\ \text{hr.°C.}$$

Heat transfer coefficient due to compulsive convection:

$$2{,}000\text{–}10{,}000\ \text{Kca./m}^2.\text{hr.°C.}$$

The flow conditions in flowing water where the quantity is constant are expressed as follows:

$$Q = A_1V_1 = A_2V_2 = \ldots = K = \text{constant}$$

where Q is the quantity of flow; $A_1$ and $A_2$ are the crosssectional areas of the flow passage; and $V_1$ and $V_2$ are velocities.

Figure 1:
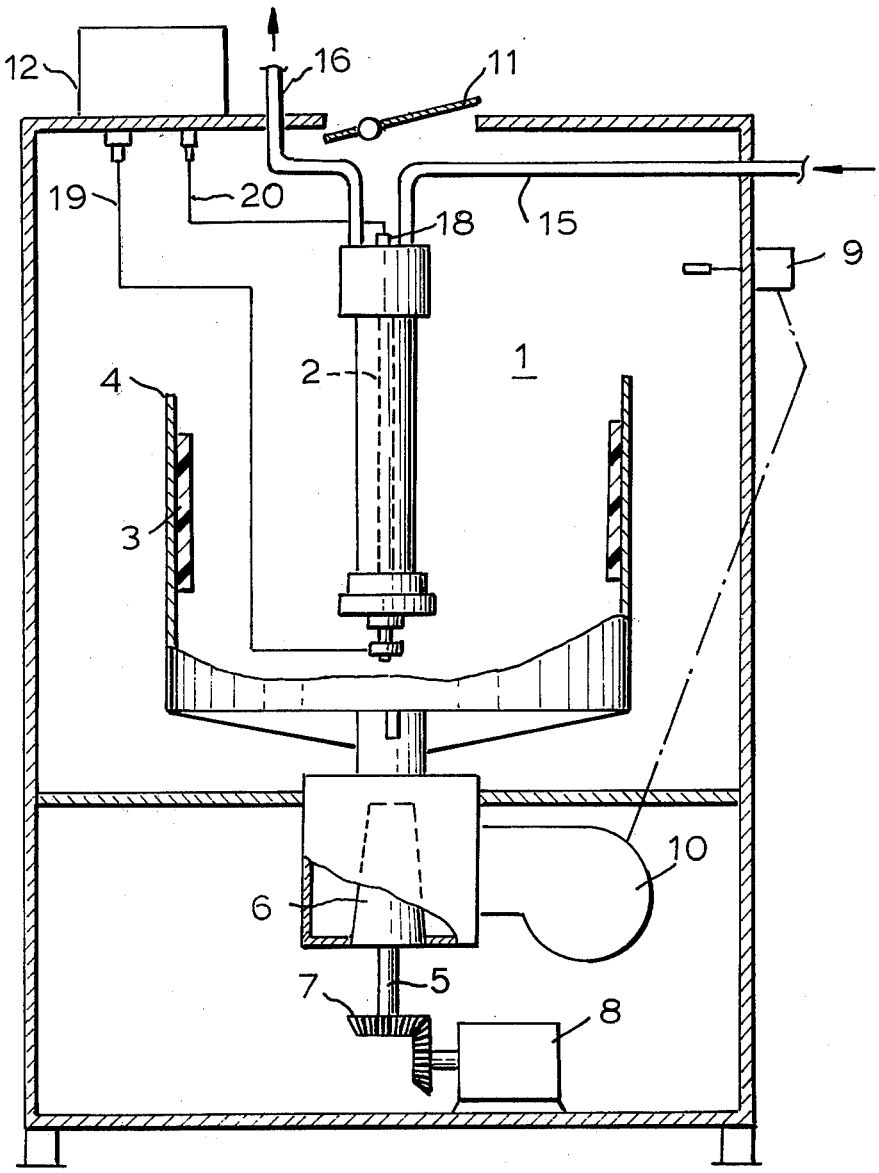
(PRIOR ART) FIG.1
FIG. 1 is a schematic view of the inside of a conventional light resistance tester incorporating a conventional xenon lamp cooling means.
Figure 2:
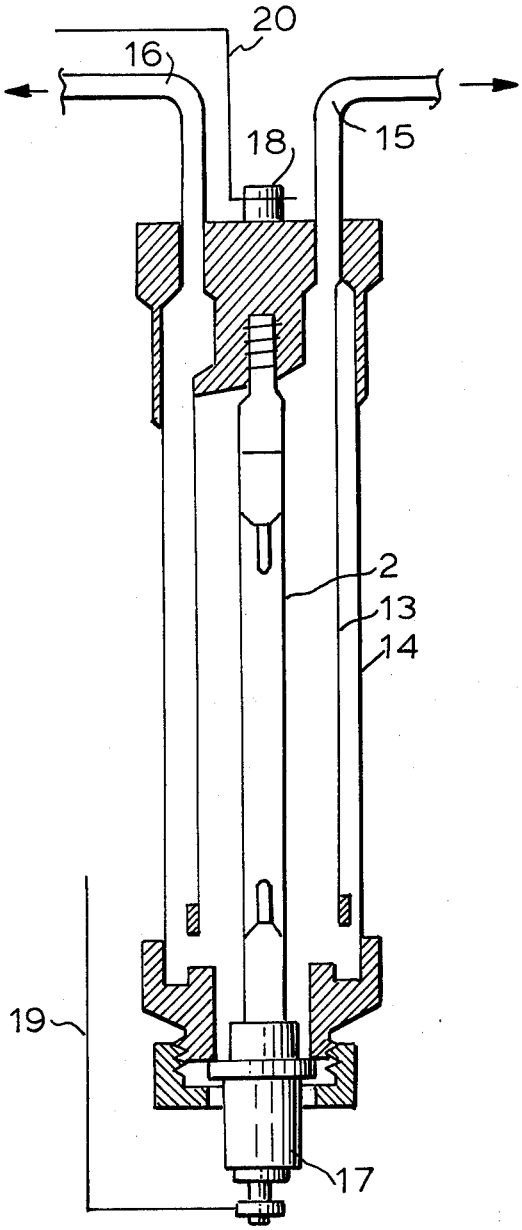
(PRIOR ART) FIG.2
FIG. 2 is a longitudinal sectional view of a conventional lamp device having a conventional cooling means.
Figure 4:
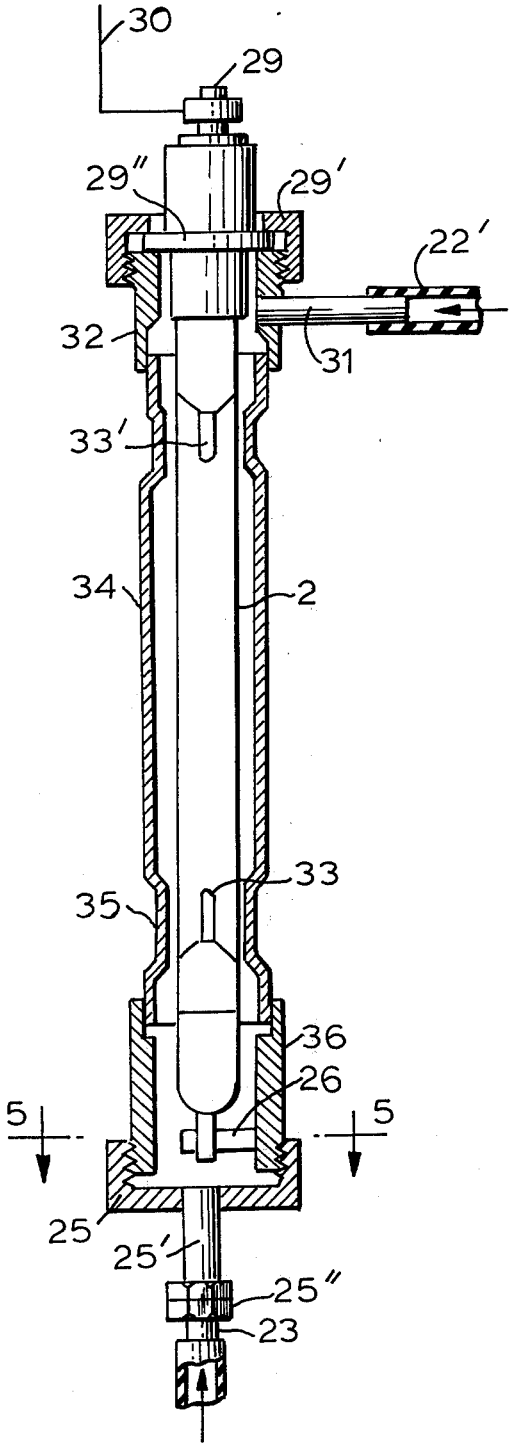
FIG. 4 is a longitudingal sectional view of the xenon lamp device having conventional cooling means in accordance with the present invention.

In the present invention, throats 35 and 35' having a reduced diameter, and hence a smaller cross-section area are formed as shown in FIG. 4 at positions along the length of a cylindrical glass cooling tube 34 which is positioned around the lamp 2' at positions opposed to the positions of the electrodes 33 and 33'. Said tube 34 is made of an ultraviolet-transmissive glass. The throats increase the flow velocity of the cooling water at the positions of the two electrodes 33 and 33' and enhance the absorption of the large amount of heat generated at the electrode portions. It is thus possible by the use of the single wall glass tube to accomplish the object of cooling the xenon lamp more effectively than by the use of a conventional double glass tube and to solve the aformentioned problem (1), i.e. poor cooling efficiency.

Since the one-way passage of the cooling water is from the bottom to the top of this single tube, the water flows upward while the temperature is elevated and air bubbles are generated. Consequently, the cooling water is transferred in the direction in which it tends to move due to obsorption of heat, whereby there is little pressure loss and the aforementioned problem (2), i.e. loss of cooling water pressure, can be eliminated. This also leads to conservation of water and an effect equal to the cooling effect of the conventional means can be attained by only one-third of the normal water flow. For example, a flow of 8l/min. has conventionally been necessary for cooling a 6KW xenon lamp at a cooling water temperature of about 20° C. In accordance with the present invention, this can be achieved by about one-third of the flow, i.e. 3l/min. and moreover, the necessary flow can be otained at a low water pressure of 0.5 Kg/cm$^2$.

In the conventional double glass cooling tube, contaminants in the water attach to three surfaces over the course of time due to and depending on the water quality. In the single cooling tube of the present invention, the contaminants attach to only one surface. (Since the attachment of the contaminants to the outer surface of the xenon lamp is the same in both cases, this is left out of consideration.) The thickness of water through which light must be transmitted in the present invention also becomes about half that of the prior art lamp means. If the light transmissivity of the surface contaminated by the water is 80%, for example, the transmissivity of the conventional cooling tube is $$0.8 \times 0.8 \times 0.8 = 0.512$$

whereas it is 0.8 in the single tube of the present invention. Hence, the difference in the transmissivity is $$0.8 - 0.512 = 0.288 \sim 30\%$$

In other words, it is possible to recover about 30% of the light transmissivity lost in a conventional lamp means. Furthermore, due to the ultraviolet rays irradiated from the lamp, the cylindrical tube of the ultraviolet-transmissive glass is itself degraded, whereby the transmissivity is reduced, and it becomes difficulty to transmit the ultraviolet rays. In the light resistance tester with the single cooling water tube of the present invention, the loss of the ultraviolet energy is only half that of the conventional double glass tube. These overcomes the aforementioned problem (3), i.e. loss of ultraviolet energy. Because ultraviolet rays which are indispensable for a light resistance test have an extremely short wavelength, they are easily absorbed by various obstacles through which they pass. As described above, the difference in the transmissivity of just the ultraviolet rays is around 30%. Thus, the rate of recover of the transmissivity of the ultraviolet rays is very great and provides an extremely great advantage for the xenon lamp type light fastness tester of the present invention.

Figure 5:
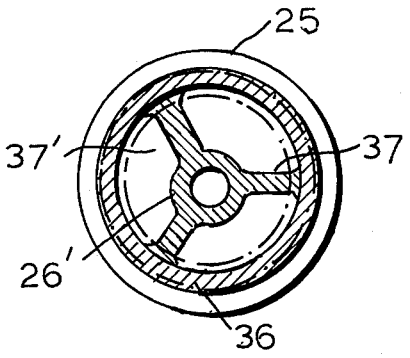
FIG. 5 is a sectional view taken along line V—V of FIG. 4.

The construction of the joints between the cooling device and the piping arrangement and the wiring will now be described with reference to FIGS. 4 through 6.

The outer circumference of the opening at the lower end of the glass cooling tube 34 is hermetically connected to the inside of the sleeve of an annular socket 36 at the low voltage end of the lamp by a water- and heat-resistant adhesive. Into the interior of this socket 36 is threaded, from below, a connection terminal 37 having a threaded hole 26' in the center thereof a low voltage terminal 26 at the lower end of the xenon lamp 2' and having cooling water passages 37' defined around this hole 26' (see FIG. 5). To the outer circumference of the socket 36 is threaded in sealed relationship, from below, a socket joint 25 from which a short metallic inlet short pipe 25' for the cooling water projects downward.

Figure 6:
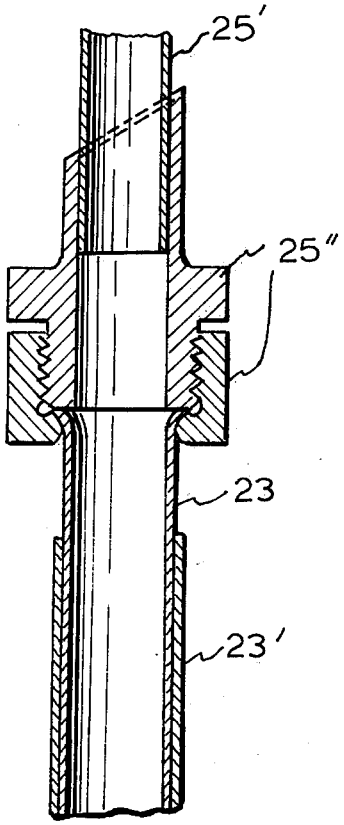
FIG. 6 is a longitudinal section view of the socket joint on the low pressure side and the Parker joint of the copper tube.

A known Parker joint 25'' is mounted on the lower end of the short pipe 25' as shown in FIG. 6 in electric and fluid communication with the copper tube 23.

The outer circumference of the upper opening of the cooling glass tube 34 is sealingly connected by a water- and heat-resistant adhesive to the inner circumference surface of an annular socket 32 on the high voltage end from which a short outlet tube 31 for the cooling water projects transversely. A cap nut 29' is sealing threaded onto the upper circumferential surface of the socket 32 holding a flange 29'' of a high voltage terminal 29 of the xenon lamp 2' tightly against the socket 32.

The short outlet tube 31 is connected to the external piping by a connecting tube 22' similar to the elastic connecting tube 22 of electrically insulating material a light-shielding plate 38 (see FIG. 3) is disposed below the high voltage lead wire 30 as to prevent exposure of the lead wire 30 to the rays of light from the lamp 2'.

The xenon lamp 2' is energized to cause it to emit the light by an electric circuit comprising the lighting device 12, the high voltage lead wire 30, the high voltage terminal 29, the annular socket 32 on the high voltage end of the lamp, the electrodes 33 and 33', the low violtage terminal 26, the connecting terminal 37, the annular socket 36 on the low voltage end, the socket 25, the copper tube 23, the lead wire terminal 28, and the low voltage lead wire 27. At the same time, the xenon lamp 2' is cooled by the cooling water flowing through the system comprising the copper tube 23, the socket joint 25, the cooling water holes 37', the annular socket 36 on the low voltage end of the lamp, the cooling tube 34, the annular socket 32 on the high voltage end of the lamp, and the short outlet tube 31. Thus, there is provided a xenon lamp cooling device having a high efficiency that has not heretofore been obtained.

It is another advantage of the cooling means of the present invention that a saving can be made in the cost of maintenance of the tester due to the increased life of the lead wire, the reduction in the consumption of water and electric power and the reduction in the cost of production of the cooling tube.

What is claimed is:

1. A light fastness and weather resistance testing apparatus comprising: a testing tank; a hollow shaft rotatably mounted in the center of the testing tank; a sample frame mounted on said hollow shaft and extending beyond one end of said hollow shaft; means connected to said shaft for rotating said shaft; a tube of electrically conductive metal extending through said hollow shaft and having one end at the space within said sample frame; means connected to the other end of said tube for supplying a cooling liquid to said tube; a xenon lamp in said space within said sample frame and having cooling means mounted thereon, said cooling means having a single wall cylindrical tube of an ultraviolet transmissive glass around said lamp and space therefrom, the low voltage end of said lamp being mounted on said one end of said metal tube and having the low voltage terminal thereof electrically connected to said metal tube, the other end of said glass tube having a drainage tube connected thereto; a high voltage power terminal connected to the high voltage terminal of said lamp; and voltage supply means connected between said other end of said metal tube and said high voltage lamp terminal and including a connecting wire extending outside said sample frame.

2. An apparatus as claimed in claim 1 in which said hollow shaft extends vertically in said testing tank and said sample frame is above the upper end of said hollow shaft, and said metal tube extends downwardly and then laterally out of said apparatus, the lower end of said metal tube being electrically insulated from said cooling liquid supply means.

3. An apparatus as claimed in claim 1 in which said glass tube has two constrictions in the internal cross-section area thereof, one adjacent the high voltage electrode within said xenon lamp and one adjacent the low voltage electrode within said xenon lamp.

4. An apparatus as claimed in claim 1 further comprising a first annular socket of electrically conductive material at the low voltage end of said xenon lamp having the corresponding end of said glass tube sealed to one end thereof and having the other end connected to said one end of said metal tube in liquid tight engagement therewith, said socket having a connection terminal therein extending transversely of the socket and having apertures therein for passage of cooling liquid, the low voltage terminal being connected to said connection terminal, and a second annular socket at the high voltage end of said xenon lamp having the corresponding end of said glass tube sealed thereto and having said drainage tube extending laterally out of said second annular socket, and said second annular socket further having said high voltage terminal extending thereinto in sealed relationship with said second annular socket and connected to the high voltage terminal of said xenon lamp.

* * * * *